US006520442B2

(12) United States Patent
Heimann

(10) Patent No.: US 6,520,442 B2
(45) Date of Patent: Feb. 18, 2003

(54) LOOPING THICK STEEL STRIP

(75) Inventor: Bernhard Heimann, Moers (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 09/873,136

(22) Filed: Jun. 1, 2001

(65) Prior Publication Data

US 2001/0054665 A1 Dec. 27, 2001

(30) Foreign Application Priority Data

Jun. 21, 2000 (DE) ..... 100 30 606

(51) Int. Cl.[7] ..... B65H 20/26; B65H 75/02; B21C 49/00

(52) U.S. Cl. ..... 242/364.1; 72/146

(58) Field of Search ..... 242/364.1, 364; 72/146

(56) References Cited

U.S. PATENT DOCUMENTS 3,310,255 A * 3/1967 Sendzimir ..... 242/364.1
3,885,748 A * 5/1975 Costello et al. ..... 242/364.1
3,999,718 A * 12/1976 Ziemba ..... 242/364.1
4,441,661 A * 4/1984 Steinmair ..... 242/364.1
4,473,193 A * 9/1984 Cooper et al. ..... 242/364.1
4,505,438 A * 3/1985 Sendzimir et al. ..... 242/364.1
5,443,221 A * 8/1995 Petry ..... 242/364.1
5,529,257 A * 6/1996 Abbey, III et al. ..... 242/364.1
5,720,444 A * 2/1998 Wheeler et al. ..... 242/364.1
5,865,393 A 2/1999 Kreft

* cited by examiner

*Primary Examiner*—John M. Jillions
(74) *Attorney, Agent, or Firm*—Herbert Dubno; Andrew Wilford

(57) ABSTRACT

A looper for thick metal strip has a large-diameter outer basket centered on an upright axis and a small-diameter inner basket axially above the outer basket and centered on an upright axis. The strip is fed on edge and generally tangentially into the outer basket to form therein a large-diameter spiral having an inner end. Then the strip is fed upward from the spiral inner end around the inner basket and is finally pulled tangentially from the inner basket. The strip is straightened generally as it leaves the inner basket.

12 Claims, 3 Drawing Sheets

LOOPING THICK STEEL STRIP

FIELD OF THE INVENTION

The present invention relates to a looper for thick metal strip. More particularly this invention concerns such a looper used in a rolling operation for strip 4 mm to 25 mm thick and a method of looping such strip.

BACKGROUND OF THE INVENTION

In many production operations it is essential that a metal strip be fed continuously in to some production machine at a slow but constant rate. The input of strip cannot be stopped, as for instance in a pipe-making operation that shapes the strip into a tube and welds its edges together.

Hence loopers are known, for instance from German 198 38 780, in which the strip passes in loops between a pair of horizontally spaced and movable carriages. When, for instance, a leading end of a fresh strip has to be welded to the trailing end of the strip in production, the two carriages are moved together to allow the strip movement to be stopped at the intake end for the welding operation while continuing to allow it to exit from the looper at a constant speed. Such systems only work well with relatively thin strip, not for the 4 mm to 25 mm thick stock used in many operations.

U.S. Pat. No. 5,865,393 of Kreft describes another system where the loop ends are spaced vertically and where the weight of the structure holding the upper loop ends is borne by the upward pull on the structure holding the lower loop ends. This system, mainly because of the small radius it forces the strip through at the loop ends, only works with thin strip.

EP 0,076,245 describes a system having a common frame holding coaxial roller baskets whose rollers extend parallel to the horizontal basket axis. S-loops are formed near the roller baskets. This is only possible with, once again, relatively flexible and thin metal strip.

OBJECTS OF THE INVENTION

It is therefore an object of the present invention to provide an improved looper for thick metal strip.

Another object is the provision of such an improved looper for thick metal strip which overcomes the above-given disadvantages, that is which can handle steel strip in the thickness range of 4 mm to 25 mm.

A further object is to provide and improved method of looping metal strip.

SUMMARY OF THE INVENTION

A looper for thick metal strip has according to the invention a large-diameter outer basket centered on an upright axis and a small-diameter inner basket axially above the outer basket and centered on an upright axis. The strip is fed on edge and generally tangentially into the outer basket to form therein a large-diameter spiral having an inner end. Then the strip is fed upward from the spiral inner end around the inner basket and is finally pulled tangentially from the inner basket. The strip is straightened generally as it leaves the inner basket.

Thus with the system of this invention the strip is actually stored in a spiral of such size that even relatively thick strip can easily be bent to fit to it. The spiral is large enough and its turns are loose enough that the speed with which the strip can be fed into the outer turn can be quite a bit different from that at which it is pulled from the inner turn. The somewhat tighter diameter that the strip must follow as it is pulled out of the spiral is relatively short so that it can be managed without great energy expenditure, and the straightener takes out any plastic deformation imparted to the strip as it moves around the inner basket.

According to the invention the straightener is mounted on the inner basket. In addition a guide conducts the strip from the inner spiral end up around the inner basket and to the straightener. This guide conducts the strip through less than 360° about the inner-basket axis, normally about 270°. The guide includes a set of rollers including a furthest downstream roller inclined at 15° to 25° to the inner-basket axis.

The inner-basket axis is offset horizontally to the outer-basket axis. Thus the strip passes smoothly from the inner turn of the spiral up around the inner basket. In fact according to the invention an outer portion of the inner basket lies generally above the spiral inner end so that the strip passes helicoidally from the spiral inner end to the straightener.

As the strip is normally produced flat, that is with its thickness dimension and its width horizontal rollers are provided for twisting the strip from a flat position to an on-edge position both at the input and output end. Thus a typical system where the incoming strip is produced by rolling billets can work with a standard pipe-making machine.

The input feeder includes a pair of upright driven rollers pinching the strip and a hold-down roller bearing downward on the strip. This keeps the strip down in the spiral, normally riding on floor rollers.

The strip looping method according to the invention thus comprises the steps of feeding the strip horizontally on edge into a large-diameter outer basket centered on an upright axis and forming in the basket a large-diameter multiturn spiral having an inner end. Then the strip is guided from the inner end upward in a helicoid of less than 360° around a small-diameter inner basket axially above the outer basket and centered on an upright axis. Finally the strip is pulled horizontally and tangentially from the inner basket above the spiral in the outer basket.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
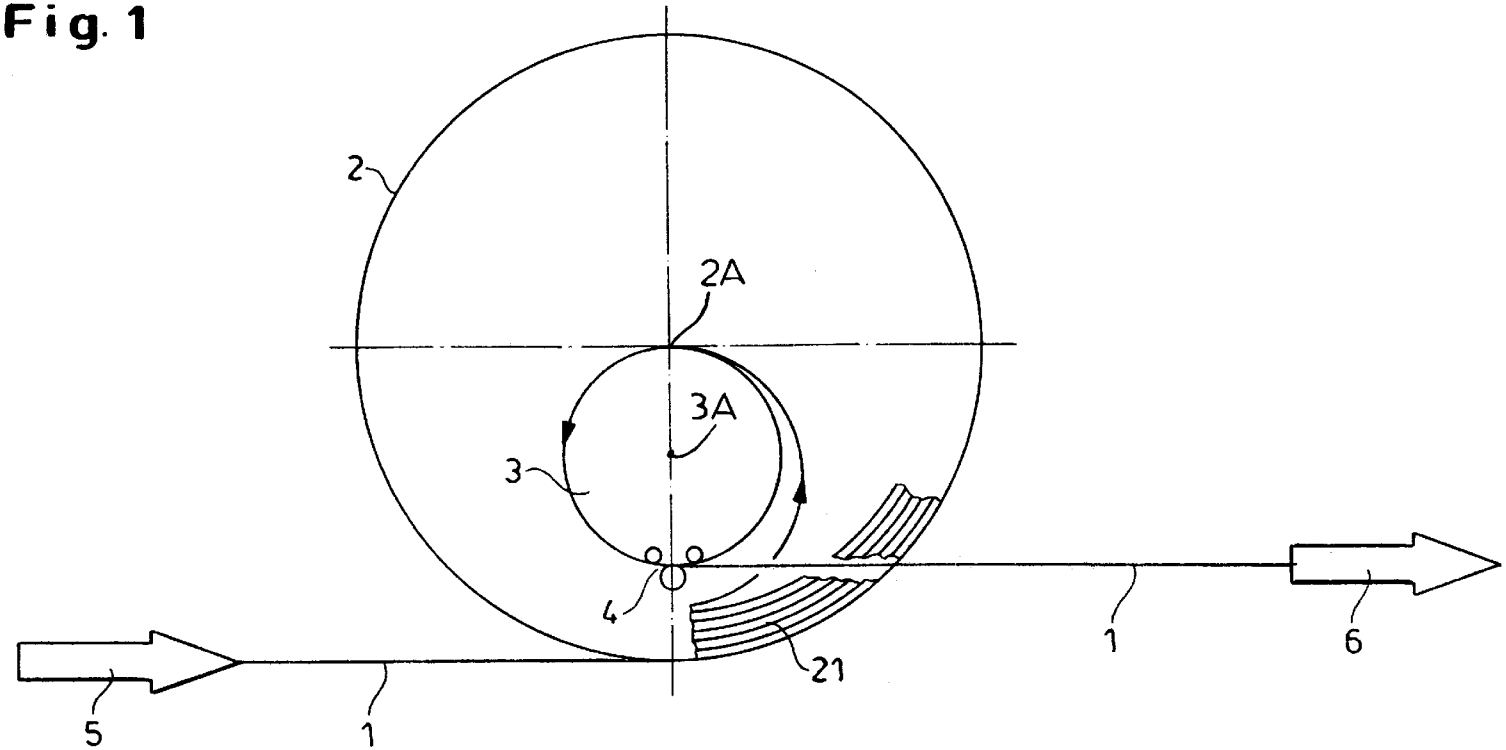
FIG. 1 is a schematic top view illustrating the looper according to the invention.
Figure 3:
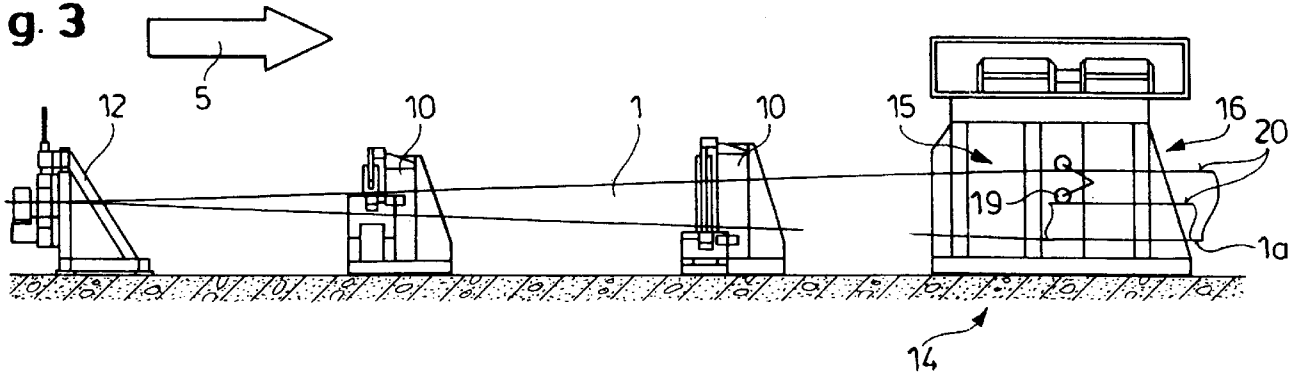
FIGS. 3 and 4 are partly schematic side views illustrating the input and output subassemblies.

As seen in FIG. 1 a steel strip 1 between 4 mm and 25 mm thick and having an edge la shown in FIG. 3 is fed in an input direction 5 into a large-diameter outer guide basket 2 having a central axis 2A. The strip stands on its edge la in the guide 2 and forms an inwardly moving spiral 21 in this outer guide basket 2. This spiral 21 can have as many as 30 turns or more so that it holds a substantial length of the strip 1.

The inner end of the spiral 21 is guided up a helicoidal guide 8 to a small-diameter basket 3 offset axially above the rim of the outer basket 2 by a distance equal at least to the maximum strip width. The strip 1 passes through about 270° as it moves helically upward along the inner basket 3 whose axis 3A is offset from the axis 2A so that movement of the strip 1 from the innermost turn of the spiral 21 in the outer basket 2 to the outside of the inner basket 3 is a smooth curve.

As the strip 1 is pulled off the inner basket 3 it passes through a set of rollers 4 that straighten it so it can be pulled straight tangentially off as indicated by arrow 6, here in line with the input direction 5. Thus any bend imparted to the strip 1 as it is wound into the outer basket 1 and fed around the inner basket 3 is eliminated.

Figure 2:
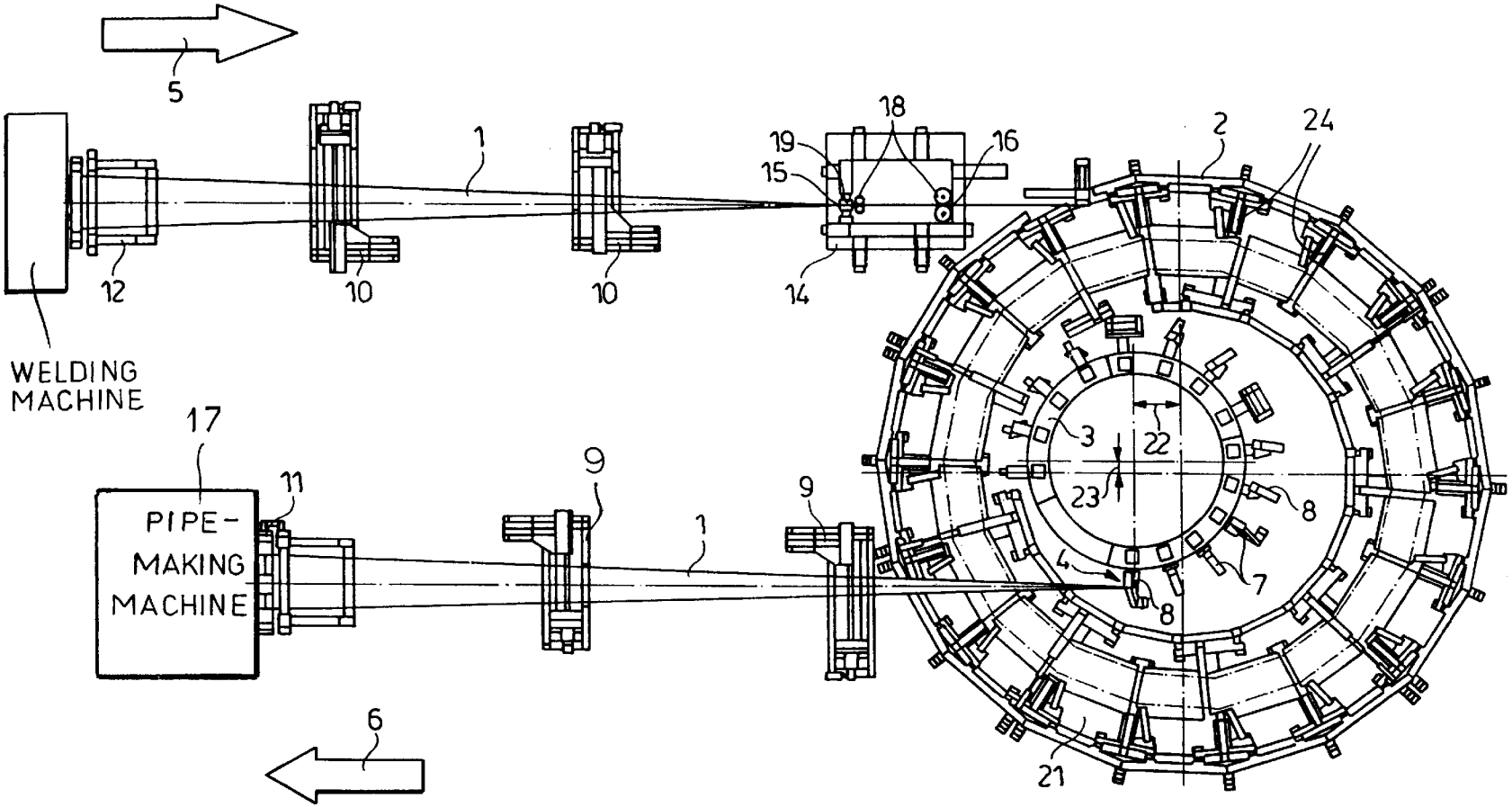
FIG. 2 is a more detailed top view of the looper.
Figure 4:
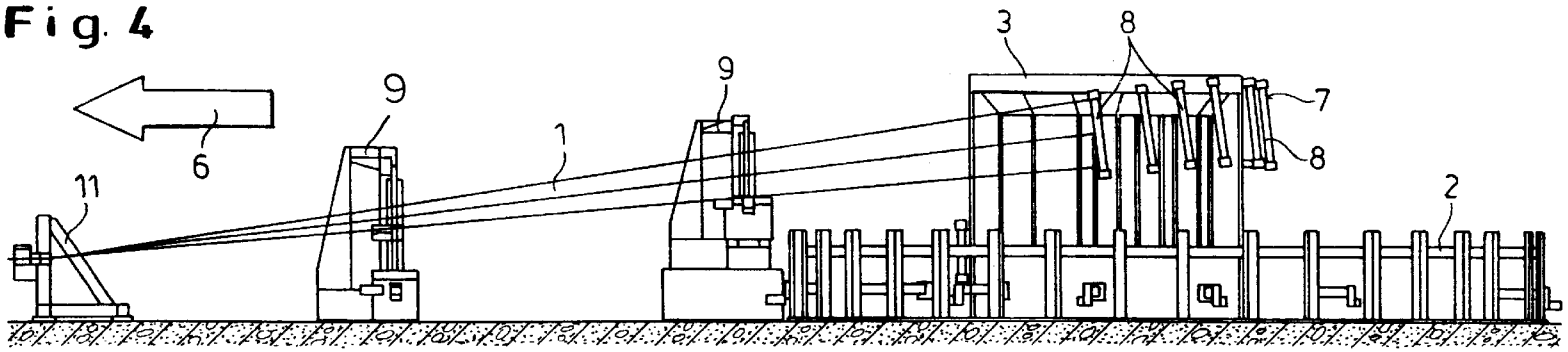

As shown in more detail in FIGS. 2 through 4, the strip 1 exits an output 12 of a welding machine 13 in flat condition, that is with its thickness dimension vertical and its width dimension horizontal and passes through two sets of increasingly angled twist-roller stations 10 that change it to an on-edge orientation with its thickness dimension horizontal and width dimension vertical. The on-edge strip 1 enters an intake 15 of an input drive 14 comprised of driven vertical rollers 18 that pinch it and advance it in the direction and a horizontal roller 19 that pushes it downward. Thus even if strips 1 of different width are being handled, as indicated at 20 in FIG. 3, the roller 19 keeps the lower strip edge la at the same level. The strip 1 leaves an output 16 of the drive 14. This drive 14 can be operated at various advance speeds and even stopped altogether during a welding operation in the machine 13.

The on-edge strip 1 enters the large-diameter outer basket 2 where it is supported on an array of horizontal floor rollers 24 rotatable about axes extending radially of the axis 2A to form the multiturn spiral 21. The turns of the spiral 21 are relatively loose so that, even though the strip 1 is being pulled out of its center at a constant speed, the strip 1 can be fed into its outer turn at a varying speed.

The inner basket 3 is offset upstream in the input direction 5, which in FIG. 2 is directly opposite the output direction 6, by a distance 22 and toward the side by a distance 23 so that this basket 3, even though of a diameter equal to only about one-third that of the outer basket 2, extends generally tangentially to the innermost turn of the spiral 21. A helicoidal guide 7 comprised of an array of fourteen angled rollers 8 guides the strip 1 up on a helicoid to wrap around the inner basket 3 by about 270°. The helicoid formed by the rising inner spiral end is sufficiently tall that by the time the strip 1 reaches the top, its lower edge is above the upper edge of the strip still sitting on the floor rollers 24.

At the end of the guide 7 the strip 1 passes through the straightener 4 and then tangentially straight away from the upper basket 3. It passes through two more sets 9 of twist rollers until it is again flat and is pulled by an input 11 into a pipe-making machine 17.

The large diameter of the outer basket 2 allows a considerable length of the strip 1 to be stored without bending it through so tight an arc that moving the strip in the spiral 21 requires significant force. The somewhat smaller diameter of the inner basket 3 does often impart some plastic deformation to the strip 1, but this is eliminated by the straightener 4.

I claim:

1. A looper for thick metal strip, the looper comprising:

a large-diameter outer basket centered on an upright axis;

a small-diameter inner basket axially above the outer basket and centered on an upright axis offset horizontally from the outer-basket axis;

input means for twisting metal strip from a flat position to an on-edge position and for feeding the metal strip on edge and generally tangentially into the outer basket to form therein a large-diameter spiral having an inner end;

output means for feeding the thick strip upward from the spiral inner end around the inner basket and tangentially from the inner basket and for twisting the strip from the on-edge position to a flat position; and means for straightening the thick strip generally as it leaves the inner basket.

2. The metal-strip looper defined in claim 1 wherein the straightening means is mounted on the inner basket.

3. The metal-strip looper defined in claim 1, further comprising guide means for conducting the strip from the inner spiral end up around the inner basket and to the straightening means.

4. The metal-strip looper defined in claim 3 wherein the guide means conducts the strip through less than 360° about the inner-basket axis.

5. The metal-strip looper defined in claim 3 wherein the guide means includes a set of rollers including a furthest downstream roller inclined at 15° to 25° to the inner-basket axis.

6. The metal-strip looper defined in claim 1 wherein an outer portion of the inner basket lies directly above the spiral inner end, whereby the strip passes helicoidally from the spiral inner end to the straightening means.

7. The metal-strip looper defined in claim 1 wherein the twisting means includes a plurality of sets of rollers.

8. The metal-strip looper defined in claim 1 wherein the input means includes a pair of upright driven rollers pinching the strip, and a hold-down roller bearing downward on the strip.

9. A method of looping metal strip of a thickness between 4 mm and 25 mm, the method comprising the steps of sequentially:

twisting the metal strip from a flat position to an on-edge position;

feeding the strip horizontally in the on-edge position into a large-diameter outer basket centered on an upright axis and forming in the basket a large-diameter multiturn spiral having an inner end;

guiding the strip from the inner end upward in a helicoid of less than 360° around a small-diameter inner basket axially above the outer basket and centered on an upright axis;

pulling the strip horizontally and tangentially from the inner basket above the spiral in the outer basket; and twisting the strip from the on-edge position to a flat position.

10. The looping method defined in claim 9, further comprising the step of straightening the strip while pulling it from the inner basket.

11. The looping method defined in claim 9 wherein the strip is pulled from the inner basket in a direction parallel to a direction in which the strip is fed into the outer basket.

12. The looping method defined in claim 11 wherein the directions are opposite.

* * * * *